US005855101A

United States Patent [19]

Schulte et al.

[11] Patent Number: 5,855,101

[45] Date of Patent: Jan. 5, 1999

[54] APPARATUS FOR RETROFITTING A METAL ROOF

[75] Inventors: Johnie Schulte; Leonard F. George, both of Houston, Tex.

[73] Assignee: NCI Building Systems, Inc., Houston, Tex.

[21] Appl. No.: 910,871

[22] Filed: Aug. 13, 1997

Related U.S. Application Data

[63] Continuation of Ser. No. 647,203, May 9, 1996, abandoned, which is a continuation of Ser. No. 264,309, Jun. 23, 1994, abandoned, which is a continuation-in-part of Ser. No. 95,845, Jul. 23, 1993, abandoned, which is a division of Ser. No. 174,355, Dec. 28, 1993, Pat. No. 5,402,572.

[51] Int. Cl.[6] ..... E04B 7/00; E04D 1/30

[52] U.S. Cl. ..... 52/506.05; 52/537

[58] Field of Search ..... 52/506.01, 506.05, 52/537, 82, 671, 672, 674, 783.17, 783.18, 783.19, 798.1; 29/897.32; D25/141

[56] References Cited

U.S. PATENT DOCUMENTS

| | | | |
|---|---|---|---|
| 1,616,968 | 2/1927 | Hall . | |
| 3,038,573 | 6/1962 | Nuernberger . | |
| 3,520,100 | 7/1970 | Webb . | |
| 3,667,185 | 6/1972 | Maurer . | |
| 3,760,549 | 9/1973 | Silberkuhl et al. | 52/537 |
| 3,760,597 | 9/1973 | Silberkuhl et al. . | |
| 3,990,206 | 11/1976 | Reusser . | |
| 4,358,916 | 11/1982 | Lacasse | 52/537 |
| 4,494,343 | 1/1985 | Berry et al. . | |
| 4,590,728 | 5/1986 | Stromberg . | |
| 4,676,042 | 6/1987 | Bell, III . | |
| 4,819,398 | 4/1989 | Dameron . | |
| 5,020,295 | 6/1991 | Haines et al. . | |

FOREIGN PATENT DOCUMENTS

| | | |
|---|---|---|
| 1-178651 | 7/1989 | Japan . |
| 1-178652 | 7/1989 | Japan . |
| 1-178653 | 7/1989 | Japan . |
| 1-178654 | 7/1989 | Japan . |
| 1-226966 | 9/1989 | Japan . |
| 1-271567 | 10/1989 | Japan . |
| 1-271569 | 10/1989 | Japan . |
| 3-158554 | 7/1991 | Japan . |
| 4-20643 | 1/1992 | Japan . |
| 2 063 961 | 6/1981 | United Kingdom . |

OTHER PUBLICATIONS

Foreign Application—Hei 1[1989]–226966, Yokota, et al., Japan Mar. 7, 1989.

*Primary Examiner*—Michael Safavi
*Attorney, Agent, or Firm*—Michael A. O'Neil

[57] ABSTRACT

An apparatus for retrofitting a metal roof includes a plurality of dual-tiered major ribs and a plurality of panel flats spaced therebetween, such that when installed over an existing metal roof containing overlapping R panels, the major ribs of the new roof panel are aligned with the major ribs of the underlying roof panel.

8 Claims, 7 Drawing Sheets

APPARATUS FOR RETROFITTING A METAL ROOF

This application is a continuation of U.S. application Ser. No. 08/647,203, filed May 9, 1996, now abandoned, which is a continuation of U.S. application Ser. No. 08/264,309, filed Jun. 23, 1994, now abandoned, which is a continuation-in-part of U.S. application Ser. No. 08/095,845, filed Jul. 23, 1993, now abandoned, which is a divisional of U.S. application Ser. No. 08/174,355, filed Dec. 28, 1993, now U.S. Pat. No. 5,402,572.

BACKGROUND OF THE INVENTION

The metal building and related metal components industry has produced a common profile for roll-formed exposed metal roofing typically referred to as an "R" panel. R panels typically utilize screws to attach the roof panels to the underlying support structure. Because R panels have been available for many years, many of the original panels are now deteriorating due to corrosion and wear. Prior art techniques for repairing worn-out R panels include complete roof replacement, in-place coatings such as paint and modified foam coatings, and oversheeting the existing roof using longitudinal secondary members sufficient to support a new roof system.

While the above-described methods have merit, there are also disadvantages associated with each. With complete roof replacement, the building interior may be exposed to adverse weather conditions during the replacement process. In-place coatings are typically not very durable and are subject to corrosion. Oversheeting the existing roof with secondary support members prior to installing a new roof is costly and time-intensive because the installer typically has to remove existing roof fasteners prior to installing the new roof. In addition, because fasteners are typically installed in the roof panel flats, there is a propensity for leakage in these areas. Thus, there is a need for a roof panel configuration that permits installation of a new roof over a variety of existing roofs without requiring the removal of the existing roof and the addition of a secondary support structure.

SUMMARY OF THE INVENTION

The present invention comprises an apparatus for retrofitting a metal roof that overcome the disadvantages associated with the prior art. An apparatus for retrofitting a metal roof comprises a plurality of dual-tiered major ribs and a plurality of panel flats spaced therebetween. Each dual-tiered major rib includes a head member and a shoulder member. The head member comprises a flat surface from which two angled surfaces slope downwardly and outwardly. Each shoulder member comprises a pair of flat surfaces from which a pair of angled surfaces slope downwardly and outwardly.

DESCRIPTION OF THE DRAWINGS

For a more complete understanding of the present invention and the advantages thereof, reference is now made to the following Detailed Description taken in conjunction with the accompanying Drawings in which.

DETAILED DESCRIPTION

Figure 1:
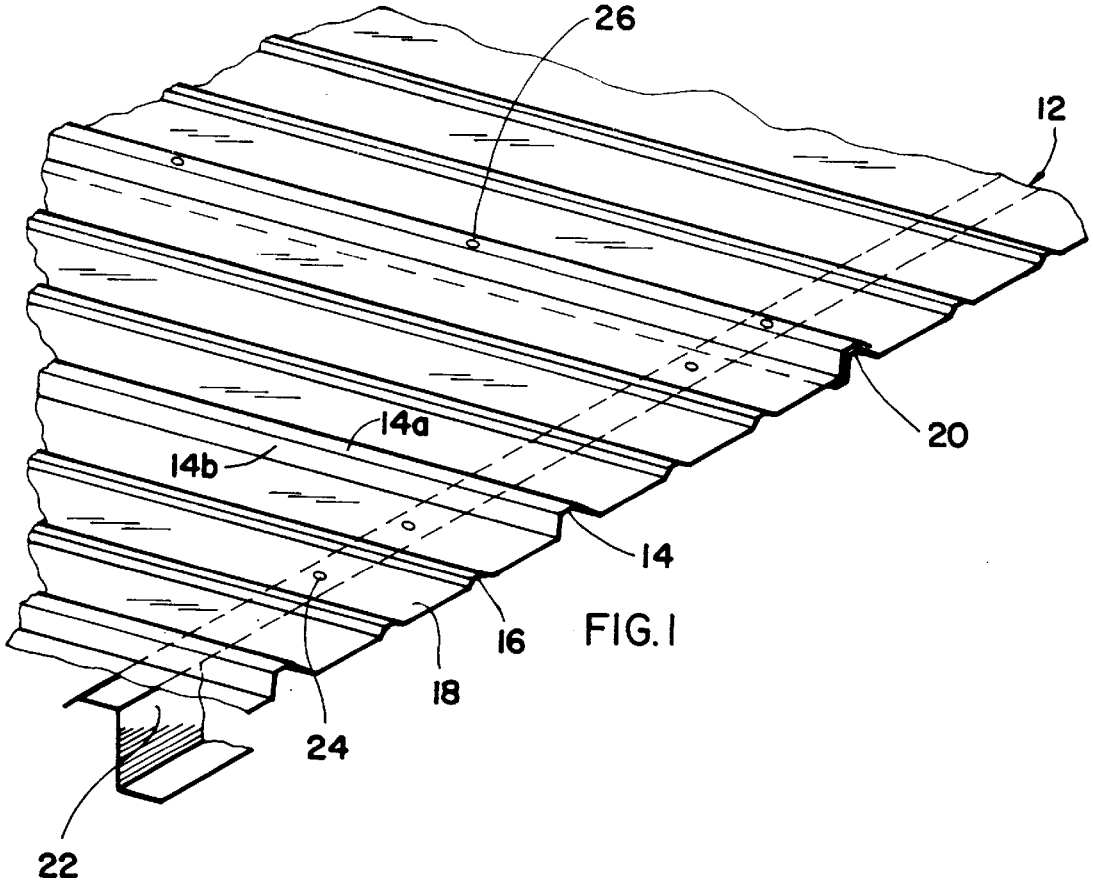
FIG. 1 is a perspective view of a portion of a conventional prior art R roof panel, illustrating the relationship between the R roof panel and the underlying support structure.
Figure 2:
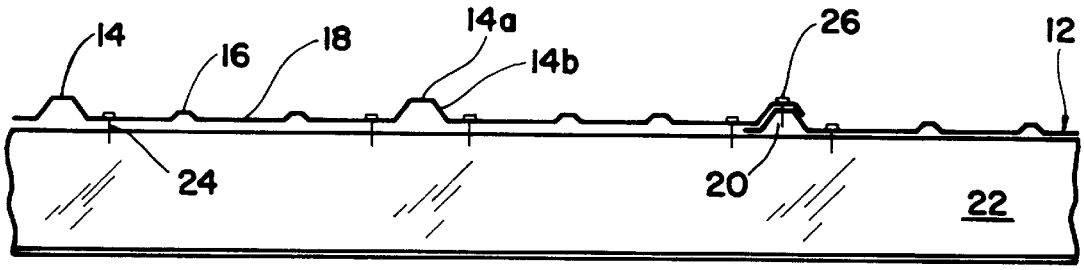
FIG. 2 is a cross-sectional view of the R roof panel of FIG. 1 installed according to prior art methods.

Referring now to the Drawings wherein like reference characters designate like or similar parts throughout the five views, FIG. 1 is a perspective view of a typical R roof panel. FIG. 2 is a cross-sectional view of the R panel of FIG. 1 installed according to prior art methods. Certain fundamental patterns are repeated by most prior art roof panel manufacturers, although placement and dimensions of individual components of the roof panel may vary with a particular manufacturer or product. Typically, an R panel 12 is configured to include a series of major ribs 14 and minor ribs 16 separated by panel flats 18.

Although they may have any configuration, the minor ribs 16 usually have a similar configuration as, but different dimensions than, the major ribs 14. The major ribs 14 are configured with a flat, upper surface 14*a* from which two angled surfaces 14*b* slope downwardly and outwardly from the flat, upper surface 14*a*. Each angled surface 14*b* terminates against an adjacent panel flat 18. Each major rib 14 of an R panel often resembles an inverted, flat-bottomed "V," however, different configurations are also possible.

The typical height of a major rib 14 is one to one and three-eighths inches (1" to 1⅜"). The typical length of the upper surface 14*a* of a major rib 14 is three-fourths to one and one-half inches (1¾" to 1½"). Major ribs 14 are commonly spaced approximately one foot (1') apart from center, with one or more minor ribs 16 therebetween.

One edge of an R panel 12 may be positioned to fully or partially overlap a similar edge of an adjacent R panel, thereby forming a lap rib 20. Caulking or sealant tape (not shown) is disposed between the plys seals adjacent R panels.

Prior art methods for installing a metal roof require that a secondary support member 22 be secured to the primary frame (not shown) prior to installation of the R panels 12. The secondary support member 22 may be zees, cees, channel or bar joists, or hot roll beams. This secondary support member 22 is positioned perpendicular to the length of the major and minor ribs. Self-driller or self-tapper fasteners 24, such as structural screw inserts or some other form of fastener, are installed adjacent to the panel ribs 14 to secure the R panel 12 to the secondary support member 22. Fasteners 26, such as screws or rivets, are inserted into the flat, upper surfaces of overlapping adjacent R panels to secure, and prevent shifting of, the panels. The fasteners 26 do not penetrate the secondary support member 22.

Figure 3A:
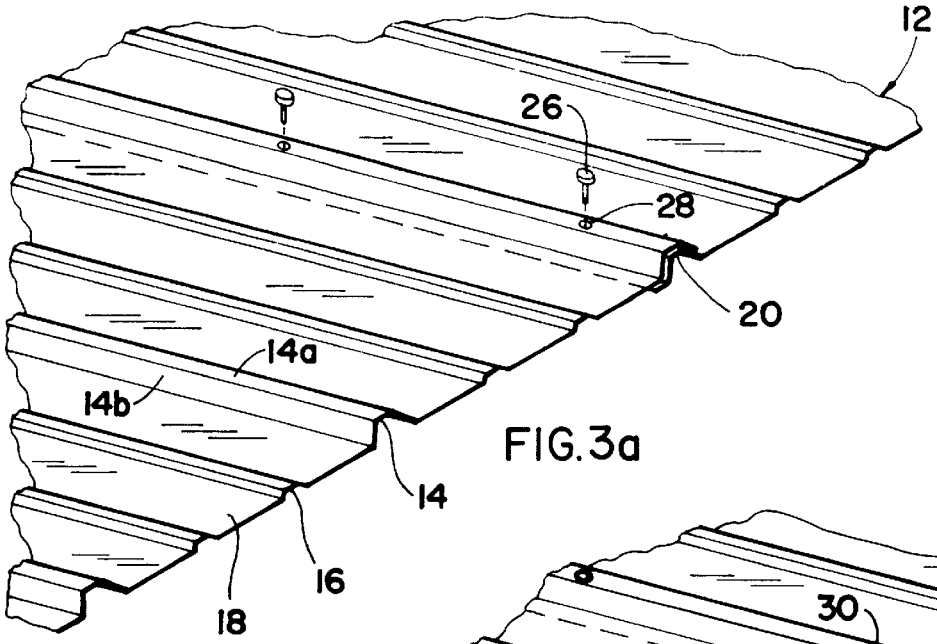
FIGS. 3*a* through 3*g* are perspective views of the steps comprising the method for retrofitting a metal roof using a novel "RETRO R" roof panel according to the present invention.
Figure 3B:
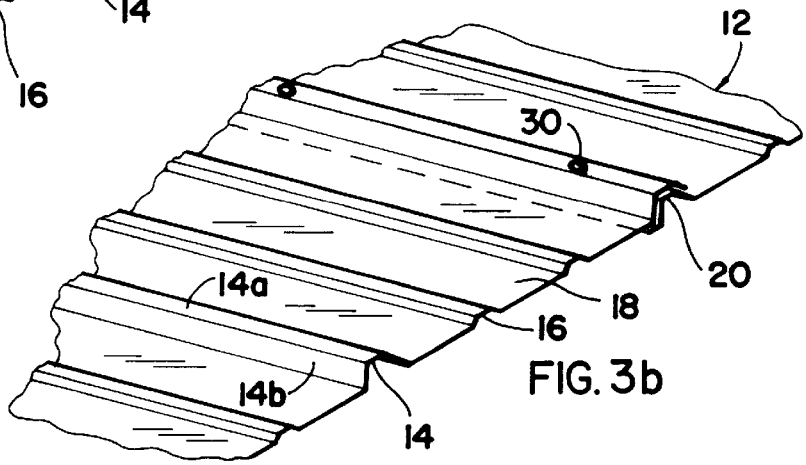

Turning now to FIGS. 3*a* through 3*g*, there are shown perspective views of the steps comprising the method for retrofitting a metal roof according to the present invention using a novel "RETRO R" panel. First, previously installed screws 26 are removed from holes 28 in the flat, upper surface of the lap rib 20 formed by the overlapping of two adjacent R panels 12. Next, conventional pop rivets 30 are inserted into the holes 28 (not shown) created by the fasteners 26 in the flat, upper surface of the lap rib 20. FIG. 3*b* illustrates the pop rivets' position following their insertion into the holes 28.

Figure 3C:
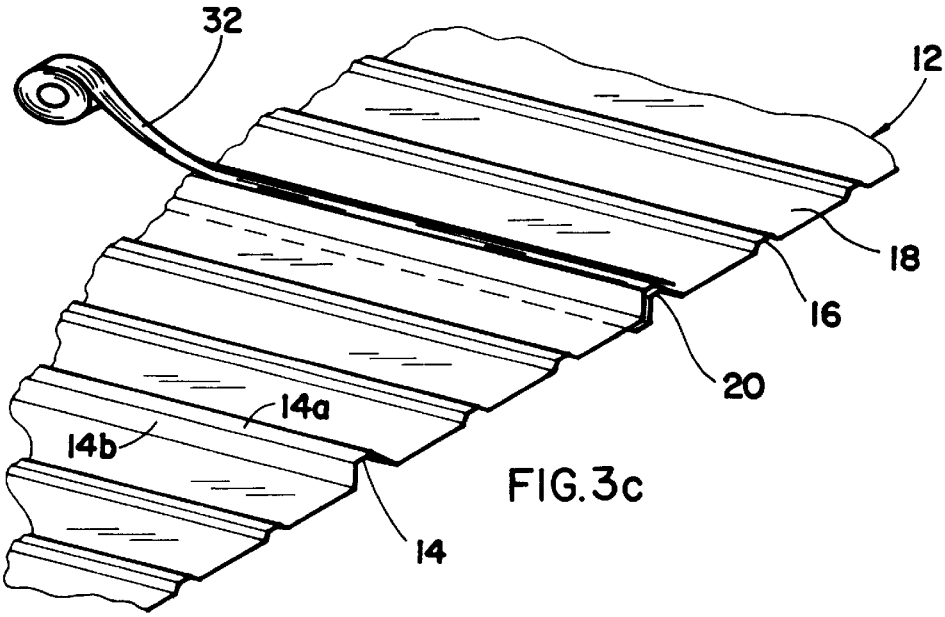

As illustrated in FIG. 3*c*, sealant tape 32 may be used to cover the pop rivet-filled holes in the lap rib 20. Preferably, the sealant tape 32 is positioned along the length of each lap rib 20. This step, although desirable, is not required. The sealant tape 32 functions to deter or prevent water leaks around the holes 28 into the building and to cushion the contact between the pop rivets 30 and the "RETRO R" panel.

Figure 3D:
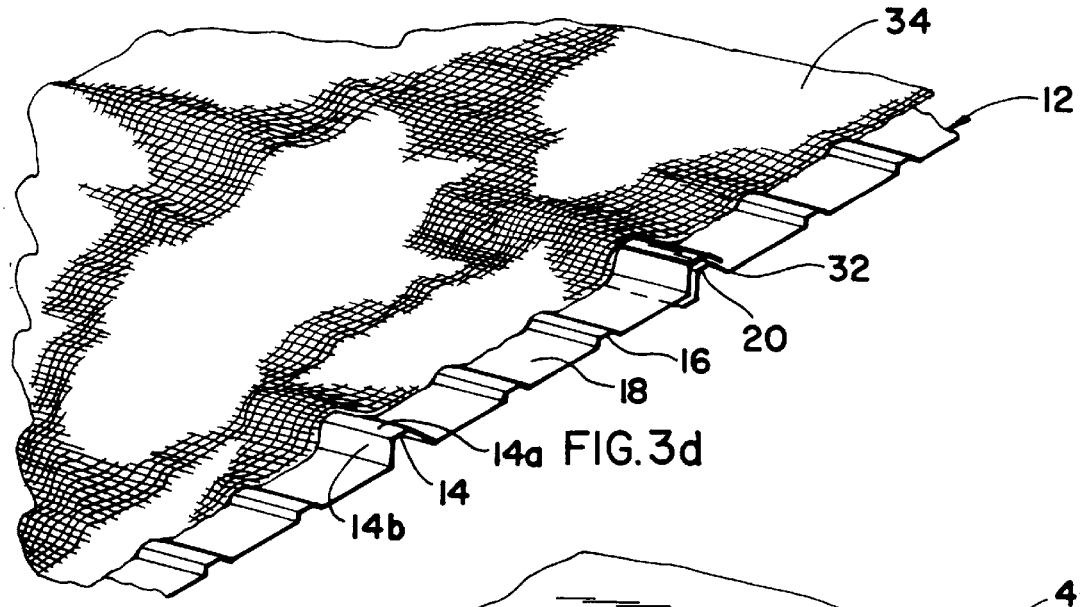

Referring now to FIG. 3*d*, conventional felt paper or closed cell foam blanket 34 may be draped over the existing R panel 12. Fifteen weight felt paper is preferred. In the alternative, high-density polyethylene foam may be used. The felt paper or foam sheeting 34 substantially covers the R panel 12, but is not attached thereto. The felt paper or foam sheeting 34 is loosely positioned between the "RETRO R" panel 40 and the underlying R panel 12.

The felt paper or foam sheeting may remain loose between the panels or alternatively, the felt paper or foam sheeting may be attached to the underside of the "RETRO R" panel. Attachment of the felt paper or foam sheeting to the underside of the "RETRO R" panel is via glue or a similar attachment means. The felt paper or foam sheeting assists in deterring or preventing condensation from forming between the existing R panel 12 and the "RETRO R" panel 40.

Figure 3E:
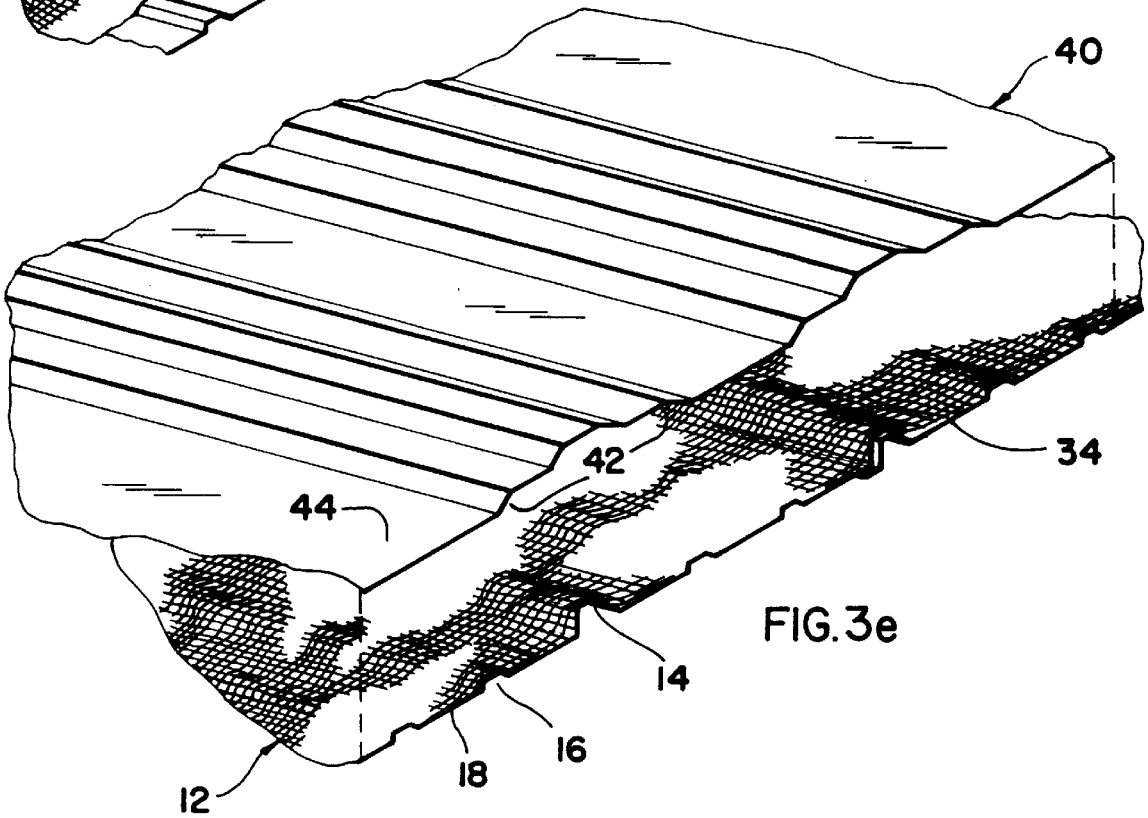

Turning to FIG. 3*e*, a novel "RETRO R" panel 40 according to the present invention is positioned over the felt paper-covered R panel 12. If the felt paper or foam sheeting has been previously attached to the underside of the "RETRO R" panel, the steps illustrated in FIGS. 3*d* and 3*e* may be combined. The "RETRO R" panel 40 comprises a series of dual-tiered major ribs 42 separated by panel flats 44. As illustrated in FIG. 3*e*, each major rib 42 of the "RETRO R" panel comprises a dual-tiered structure. The first tier or head member comprises a single flat surface 42*a* and two angled surfaces 42*b* which slope downwardly and outwardly from the flat, upper surface 42*a* of major rib 42. Each angled surface 42*b* of the head member terminates against a second tier or shoulder member.

The shoulder member of the major rib 42 comprises two flat surfaces 42*c* and two angled surfaces 42*d* which slope downwardly and outwardly from flat surfaces 42*c*. The two flat surfaces 42*c* of the shoulder member are substantially parallel to the flat surface 42*a* of the head member. Each angled surface 42*d* of the shoulder member terminates against an adjacent panel flat 44. The angle of slope of angled surfaces 42*b* and 42*d* may be varied as desired.

Preferably, the lengths of the flat surfaces 42*a* and 42*c* of the head and shoulder members are substantially the same. The flat surface 42*a* of the major rib 42 is approximately one and one-half inches (1½") long and has a height of one-half inch (½") from the horizontal plane of the shoulder member. The two angled surfaces 42*b* of the head member are each eleven-sixteenth inches (11/16") long.

Regarding the shoulder member, each flat surface 42*c* is approximately one and five-eights inches (1⅝") long and has a height of five-eighths inches (⅝") from the horizontal plane of the adjacent panel flats 44. Each angled surface 42*d* of the shoulder member is approximately seven-eights inches (⅞") long.

The major ribs 42 of the "RETRO R" panel are spaced apart to ensure that the "RETRO R" panel will cover the existing R panel and that there will be proper alignment of the upper surface 42*a* of the major ribs of the new roof panel with the upper surface of the major ribs of the existing roof panel. In most applications, this will require a spacing of about one foot (1'). The "RETRO R" panel is configured to have the same inter-major rib distance as the underlying roof panels to ensure proper alignment of the upper surfaces of the respective major ribs.

The configuration of the "RETRO R" panel 40 is substantially different than the configuration of the prior art R panel 12. The "RETRO R" panel 40 has no minor ribs. The panel flats 44 of the "RETRO R" panel 40 are substantially longer than the corresponding panel flats 18 of the prior art R panel. Each major rib 42 of the "RETRO R" panel 40 is dual-tiered, with three flat surfaces 42*a* and 42*c* and two pairs of angled surfaces 42*b* and 42*d*. The prior art R panel 12 has one flat surface and a single pair of angled surfaces. The unique configuration of the "RETRO R" panel's major ribs 42 and panel flats 44 functions to permit installation of the "RETRO R" panel 40 over many different configurations of prior art R panels. The two-tiered shape of the "RETRO R" major rib 42 is configured so that the original roof fasteners (24 in FIGS. 1 and 2) can remain in place without interfering with the installation of the "RETRO R" panel 40.

As installed, the general configuration of the "RETRO R" panel 40 will not necessarily correspond to or follow the shape of the underlying R panel 12, except at the upper surfaces of the major ribs. The panel flats 44 of the "RETRO R" panel 40 may or may not make physical contact with the upper surfaces of the minor ribs 16 of the underlying R panel 12 when installed. The "RETRO R" panel 40 will define a clearance 46, which will accommodate the top of the structural fasteners 24 projecting above R panel 12, thereby obviating the removal of the fasteners prior to installing the "RETRO R" panel 40.

Figure 3F:
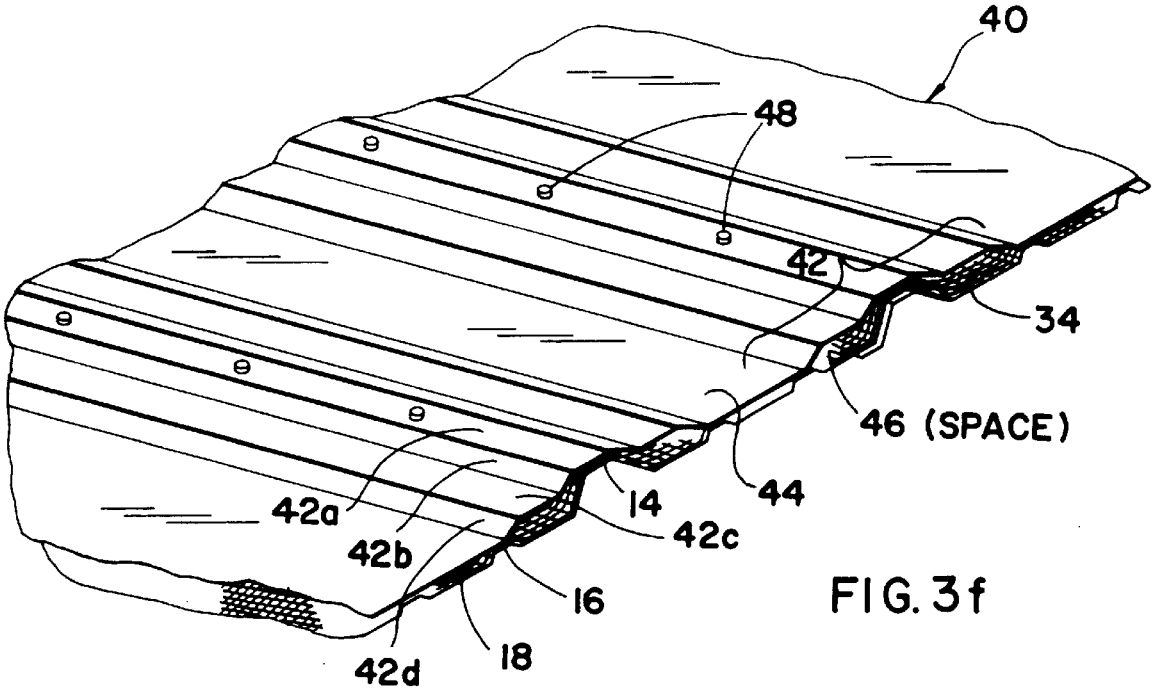

As illustrated in FIG. 3*f*, structural fasteners 48 are then inserted into the flat, upper surface 42*a* of major rib 42 to secure the "RETRO R" panel 40 to the underlying R panel 12. The structural fasteners 48 extend downwardly through the flat, upper surface 14*a* of the underlying R panel's major rib 14. No additional structural fasteners are required to secure the "RETRO R" panel 40 to the underlying R panel 12. Felt paper or foam sheeting 34 separates and insulates the two roof panels.

Figure 3G:
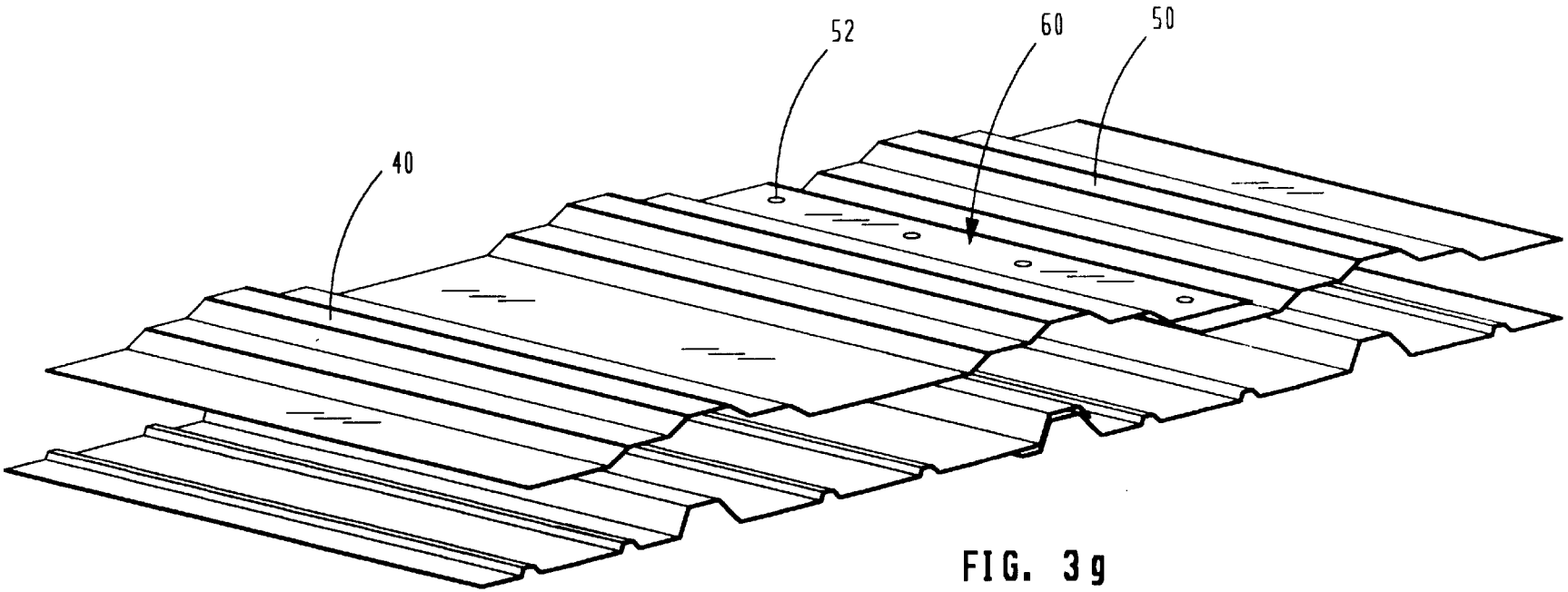

Finally, as illustrated in FIG. 3*g*, an edge of a "RETRO R" panel 40 may be positioned to partially overlap a similar edge of an adjacent "RETRO R" panel 50 thereby forming a lap panel 60. For ease of viewing only, the felt paper or foam sheeting 34 has been removed in FIG. 3*g*. Fasteners 52 are inserted into the surfaces of overlapping adjacent "RETRO R" panels 40 and 50 to secure, and prevent shifting of, the "RETRO R" panels. The fasteners 52 do not penetrate the underlying R panel or the sub-structure (not shown). The fastened, overlapping terminating ends of adjacent "RETRO R" panels are not secured to the underlying R panel or to the sub-structure since the only attachment between the "RETRO R" panels and the underlying R panel is at the major ribs.

Figure 4:
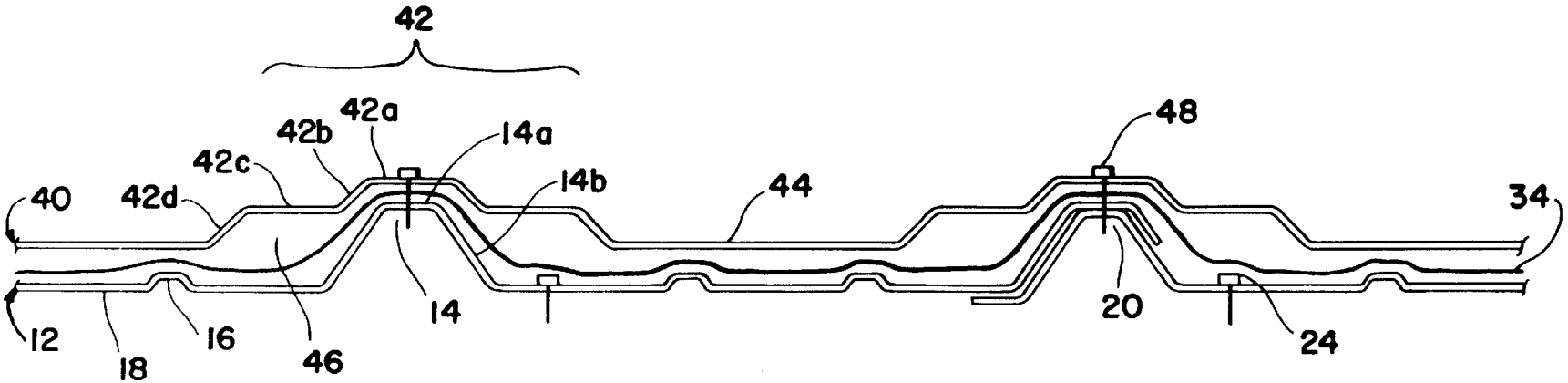
FIG. 4 is a cross-sectional view of an installed "RETRO R" roof panel according to the present invention, illustrating the relationship between the new and existing roofs.

FIG. 4 is a cross-sectional view of a "RETRO R" panel 40 installed according to the present invention, illustrating the relationship between the underlying R panel 12 and the "RETRO R" panel 40. The underlying R panel 12 is configured with a series of major ribs 14 and minor ribs 16 separated by panel flats 18. Structural fasteners 24 disposed in the panel flats 18 secure the R panel to the underlying structure. Felt paper or foam sheeting 34 separates the R panel 12 and the "RETRO R" panel 40.

The "RETRO R" panel 40 includes a plurality of dual-tiered, major ribs 42 separated by panel flats 44. A clearance 46 defined by the configuration of the "RETRO R" panel 40 is provided between the preexisting and newly applied roof panels. Structural fasteners 48 are inserted through surface 42*a* of major rib 42 of the "RETRO R" panel 40 and surface 14*a* of the R panel 12 to attach the two roofs.

Figure 5:
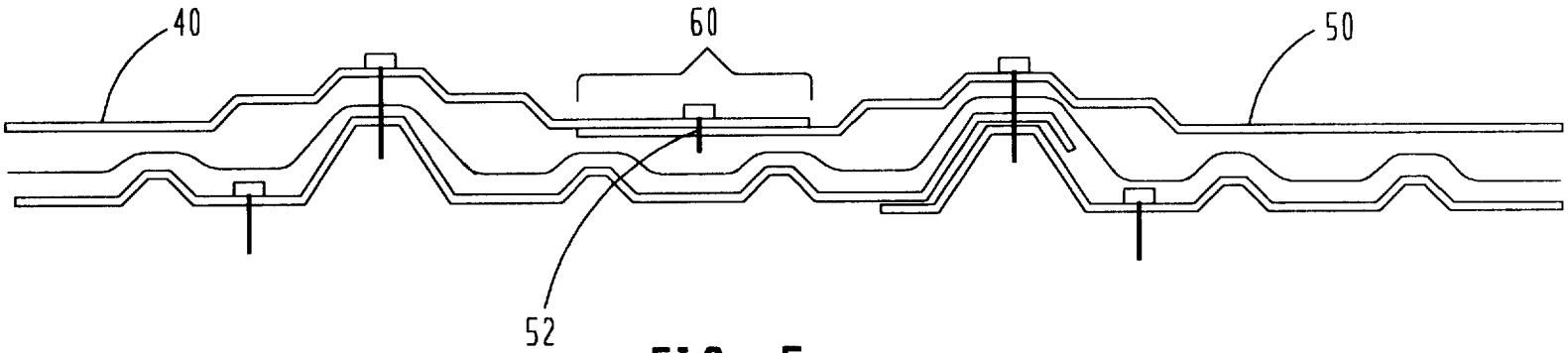
FIG. 5 is a cross-sectional view of an installed "RETRO R" roof panel according to the present invention, illustrating the relationship between adjacent "RETRO R" panels.

FIG. 5 illustrates the relationship between adjacent "RETRO R" panels. Ends of adjacent "RETRO R" panels 40 and 50 overlap each other to form lap panel 60 and are secured together by fasteners 52. The fasteners 52 do not extend into the underlying R panel 12 or into the sub-structure (not shown).

The "RETRO R" panel of the present invention has several advantages over the prior art R panels, both in terms of configuration and method of installation. The configuration of the "RETRO R" panel has sufficient major rib base width to permit the "RETRO R" panel to cover the typical structural fasteners in place in an R panel, thereby eliminating the need to remove these fasteners prior to retrofitting. The novel "RETRO R" panel is configured to overlay most of the R panel major ribs presently in use today. The "RETRO R" panel is configured to have substantially the same inter-major rib distance as conventional R panels to ensure that the "RETRO R" panel may be aligned properly when installed over the underlying prior art roof. The "RETRO R" panel is configured such that the panel flats are vertically positioned slightly above the minor ribs of most conventional R panels.

Installation of the "RETRO R" panel has advantages over prior art installation methods because installation of the "RETRO R" panel can be accomplished without exposing the building interior to adverse weather conditions. Specifically, the original roof panels (common R panels) may be left in place during the retrofitting procedure. In addition, installation is accomplished without the need to install any secondary support members on top of the existing roof panels. Moreover, because there is no need to remove the existing fasteners of the original roof panel prior to installation of the "RETRO R" panel, installation is faster and less costly, and the original structural fasteners 24 can be relied upon for securing the original panel to the secondary support members.

Finally, with an installed "RETRO R" panel, there are no fasteners through the lowermost surface of the roof panel, other than at the panel ends. All attachments of the "RETRO R" panel to the existing roof are made through the upper surface of the major rib. Thus, the propensity for water leaks is greatly reduced by eliminating the fasteners typically installed in the panel flats of prior art roof panels.

Although a preferred embodiment of the present invention has been illustrated in the accompanying Drawings and described in the foregoing Detailed Description, it will be understood that the invention is not limited to the embodiments disclosed, but is capable of numerous rearrangement, modifications, and substitutions of parts and elements without departing from the spirit of the invention.

We claim:

1.The combination of:

a roof support structure;

a plurality of original roof panels supported on the roof support structure and extending adjacent one another to define a predetermined roof area;

each of the original roof panels being substantially identical to one another;

each of the original roof panels comprising a plurality of major ribs and a plurality of flat panels extending between the major ribs;

the major ribs of the original roof panels being spaced apart an identical predetermined distance from the next adjacent major rib;

each of the major ribs of the original roof panels comprising an upper flat surface and angled surfaces extending angularly downwardly from the upper flat surface to the flat panels of the original roof panel;

a first plurality of fasteners each extending through one of the flat panels of one of the original roof panels and into the roof support structure for securing the original roof panels to the roof support structure;

a blanket comprising flexible material overlying the original roof panels and covering substantially the entire roof area;

a plurality of retro roof panels positioned over the blanket and extending adjacent one another to cover substantially the entire roof area;

each of the retro roof panels being substantially identical to one another;

each of the retro roof panels comprising a plurality of dual tier major ribs and a plurality of flat panels extending between the dual tier major ribs;

the dual tier major ribs of the retro roof panels each being spaced apart from adjacent dual tier major ribs thereof by a distance equal to the spacing between the major ribs of the original roof panels;

each dual tier major rib of the retro roof panels comprising a head portion including an upper flat surface and angled surfaces extending downwardly and outwardly from the upper flat surface and two shoulder portions located on opposite sides of the head portion and each comprising a flat surface intersected by the angled surfaces extending downwardly from the upper surface of the head portion and an angled surface extending downwardly from the flat surface of the shoulder portion and intersecting the flat panels of the retro roof panels;

the head portions of the dual tier major ribs of the retro roof panels each being positioned in alignment with a major rib of one of the original roof panels; and a second plurality of fasteners each extending through the head portion of one of the dual tier rib portions of one of the retro roof panels, through the blanket, and through the underlying major rib of one of the original roof panels to secure the retro roof panels in engagement with the original roof panels.

2. The combination according to claim 1 wherein the first plurality of fasteners comprises the sole connection between the original roof panels and the roof support structure, and wherein the second plurality of fasteners comprises the sole connection between the retro roof panels and the original roof panels.

3. The combination according to claim 1 wherein the original roof panels are interconnected at overlapping major ribs thereof by fasteners extending through the overlapping major ribs, and wherein the retro roof panels are interconnected at overlapping flat panels thereof by fasteners extending through the overlapping flat panels.

4. The combination according to claim 3 wherein the fasteners connecting the overlapping major ribs of the original roof panels are pop rivets, and further including a protective strip extending over the pop rivets and under the blanket.

5. The combination according to claim 3 wherein the fasteners interconnecting the overlapping flat panels of the retro roof panels do not engage either the original roof panels or the roof support structure.

6. The combination according to claim 1 wherein the blanket comprises felt paper.

7. The combination according to claim 1 wherein the blanket comprises closed cell plastic foam.

8. The combination according to claim 1 wherein the shoulder portions of the dual tier major ribs of the retro roof panels define spaces between the retro roof panels and the original roof panels.

* * * * *